US009169999B2

(12) United States Patent
Hsieh

(10) Patent No.: US 9,169,999 B2
(45) Date of Patent: Oct. 27, 2015

(54) LAMP DEVICE AND SECURING UNIT THEREOF

(71) Applicant: Habitex Corporation, Taipei (TW)

(72) Inventor: Pei-Lin Hsieh, Taipei (TW)

(73) Assignee: HABITEX CORPORATION, Taipei (TW)

( * ) Notice: Subject to any disclaimer, the term of this patent is extended or adjusted under 35 U.S.C. 154(b) by 105 days.

(21) Appl. No.: 14/019,437

(22) Filed: Sep. 5, 2013

(65) Prior Publication Data

US 2015/0062918 A1 Mar. 5, 2015

(51) Int. Cl.

| | |
|---|---|
| ***F21V 17/06*** | (2006.01) |
| ***F21V 17/16*** | (2006.01) |
| ***F21V 23/00*** | (2015.01) |
| ***F21V 1/02*** | (2006.01) |

(52) U.S. Cl.

CPC . *F21V 17/16* (2013.01); *F21V 1/02* (2013.01); *F21V 17/06* (2013.01); *F21V 23/002* (2013.01)

(58) Field of Classification Search

CPC ..... F21S 6/007; F21S 6/005; F21V 1/00; F21V 1/12; F21V 1/08; F21V 1/04; F21V 1/143; F21V 17/08; F21V 17/108; F21V 17/14; F21V 17/16; F21V 17/18; F21V 1/02; F21V 21/00; F21V 21/08; F21V 21/008

USPC ..... 362/353

See application file for complete search history.

(56) References Cited

U.S. PATENT DOCUMENTS

| | | | | |
|---|---|---|---|---|
| 4,275,434 | A * | 6/1981 | Borowitz | 362/352 |
| 4,277,823 | A * | 7/1981 | Suzuki | 362/352 |
| 4,851,981 | A * | 7/1989 | Ruesch | 362/452 |
| 7,473,015 | B1 * | 1/2009 | Chen | 362/367 |
| 2004/0095748 | A1 * | 5/2004 | Lin | 362/96 |
| 2005/0073842 | A1 * | 4/2005 | Pape et al. | 362/277 |
| 2006/0279954 | A1 * | 12/2006 | Sherman | 362/353 |
| 2008/0094844 | A1 * | 4/2008 | Small | 362/311 |
| 2013/0201695 | A1 * | 8/2013 | Lewis et al. | 362/353 |
| 2013/0322097 | A1 * | 12/2013 | Schaak, Lee | 362/414 |
| 2014/0317974 | A1 * | 10/2014 | Acworth et al. | 40/554 |
| 2015/0003072 | A1 * | 1/2015 | Chen et al. | 362/294 |

* cited by examiner

*Primary Examiner* — Anh Mai
*Assistant Examiner* — Matthew J Peerce
(74) *Attorney, Agent, or Firm* — DLA Piper LLP (US)

(57) ABSTRACT

A securing unit is for securing a lamp shade to a bulb socket. The lamp shade includes a shade frame, and a coupler connected to the shade frame. The bulb socket is to be disposed in the lamp shade. The securing unit includes a connecting member and a securing member. The connecting member has an upper mounting segment, and a lower connecting segment disposed below the upper mounting segment and configured for connection to the bulb socket. The securing member includes a base part having opposite first and second surfaces, an engaging part extending from the first surface and engaging the upper mounting segment of the connecting member, and a resilient holding part extending from the second surface and configured to hold the coupler.

10 Claims, 7 Drawing Sheets

LAMP DEVICE AND SECURING UNIT THEREOF

BACKGROUND OF THE INVENTION

1. Field of the Invention

The invention relates to a lamp device, more particularly to a lamp device including a securing unit for securing a lamp shade to a bulb socket.

2. Description of the Related Art

FIG. 1 illustrates a conventional lamp device 9. The lamp device 9 includes a lamp shade 91 and a bulb socket 92 disposed in the lamp shade 91 for connecting to a light bulb. The lamp shade 91 includes a shade frame 911, a coupler 912 connected to the shade fraise 911, and a shade body 913 covering the shade frame 911. The coupler 912 is for securing the bulb socket 92, and therefore, the coupler 912 must be shaped to fittingly engage the bulb socket 92.

However, both the coupler 912 of the lamp shade 91 and the bulb socket 92 that are commercially available come with a variety of respective size specifications. As a result, when one of the lamp shade 91 and the bulb socket 92 needs to be replaced, the user is limited to employ replacement part having specifications corresponding to the to-be-replaced part. For example, when a replacement lamp shade 91 is found to be unfit for the original bulb socket 92, the result may be an unstable engagement between the lamp shade 91 and the bulb socket 92, or even the need to replace the bulb socket 92 as well.

SUMMARY OF THE INVENTION

Therefore, the object of the present invention is to provide a securing unit that is able to secure a bulb socket to a variety of couplers of different lamp shades.

Accordingly, a securing unit of the present invention is for securing a lamp shade to a bulb socket. The lamp shade includes a shade frame, and a coupler connected to the shade frame. The bulb socket is to be disposed in the lamp shade. The securing unit comprises a connecting member and a securing member.

The connecting member has an upper mounting segment, and a lower connecting segment disposed below the upper mounting segment and configured for connection to the bulb socket.

The securing member includes a base part having opposite first and second surfaces, an engaging part extending from the first surface of the base part and engaging the upper mounting segment of the connecting member, and a resilient holding part extending from the second surface of the base part and configured to hold the coupler.

Another object of the present invention is to provide a lamp device that includes the aforementioned securing member.

Accordingly, a lamp device comprises a lamp shade, a bulb socket disposed in the lamp shade, and a securing unit.

The lamp shade includes a shade frame, and a coupler connected to the shade frame.

The securing unit includes a connecting member and a securing member.

The connecting member has an upper mounting segment, and a lower connecting segment disposed below the upper mounting segment and connected to the bulb socket.

The securing member includes a base part having opposite first and second surfaces, an engaging part extending from the first surface of the base part and engaging the upper mounting segment of the connecting member, and a resilient holding part extending from the second surface of the base part and con figured to hold the coupler.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
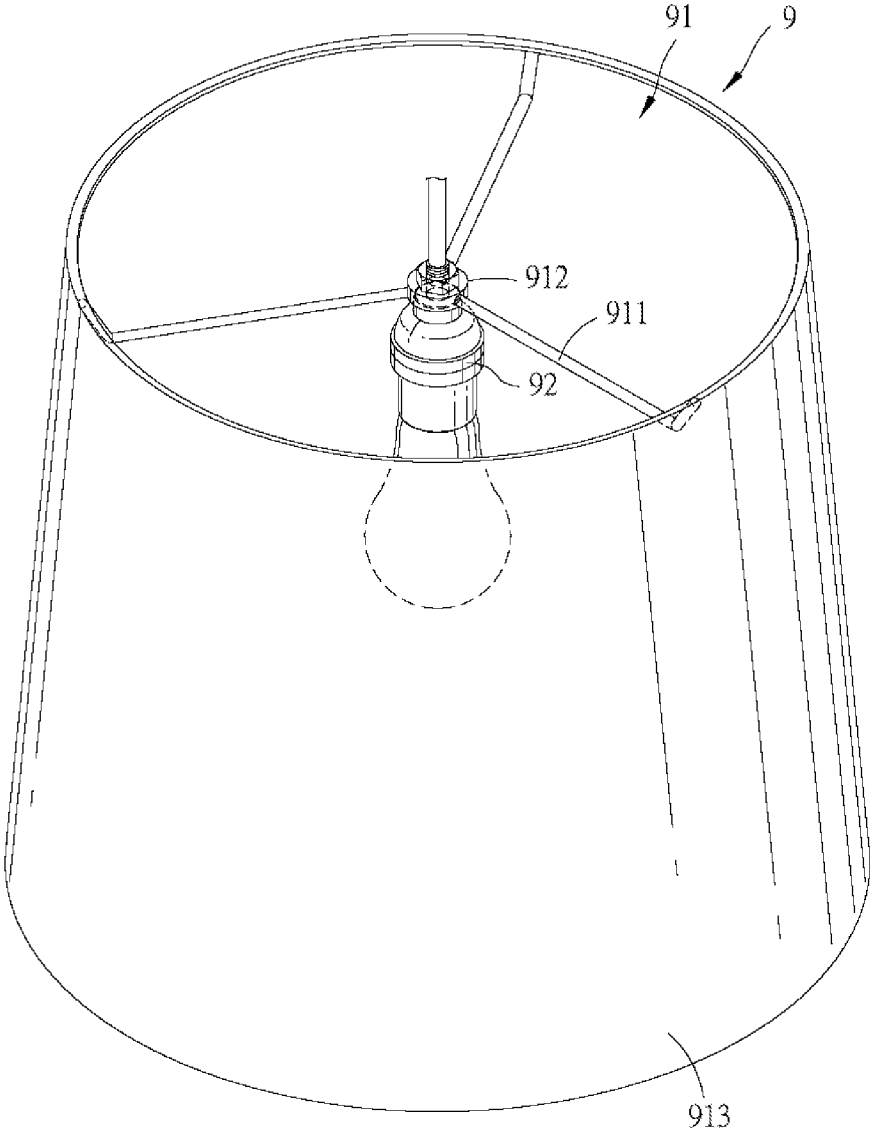
FIG. 1 PRIOR ART
FIG. 1 is a perspective view of a conventional lamp device.
Figure 2:
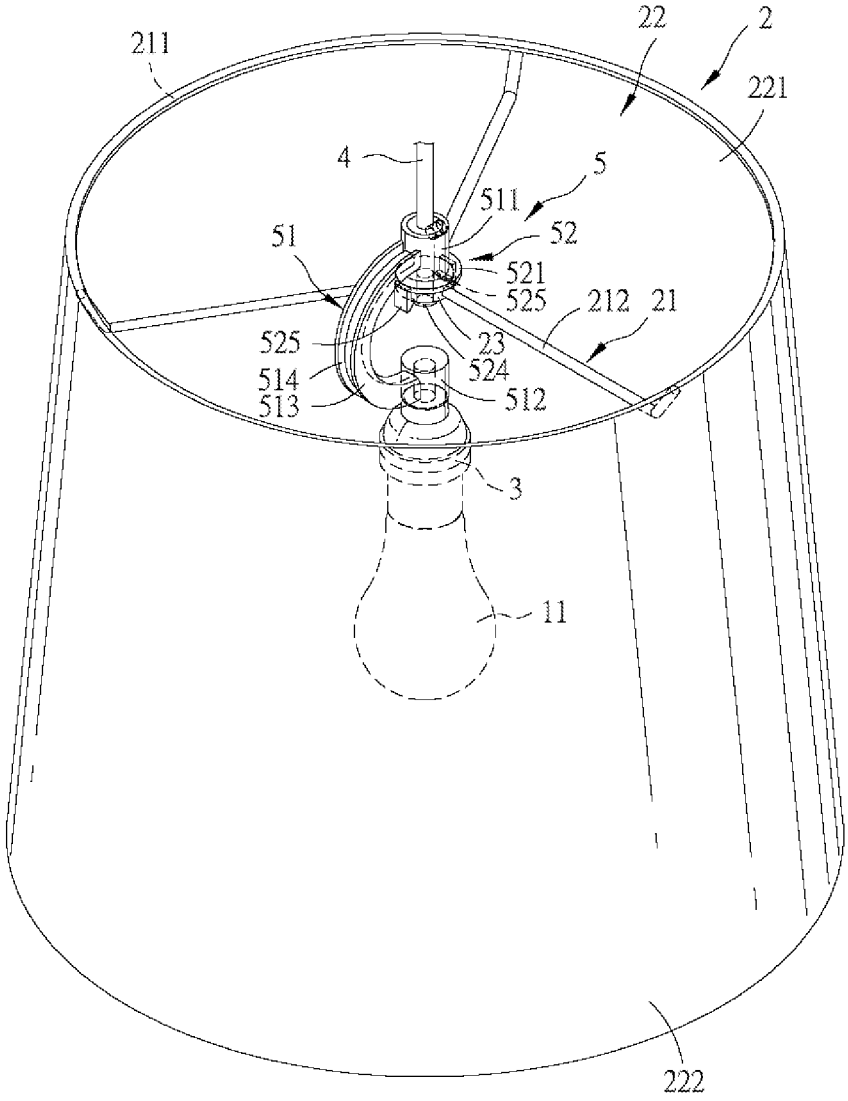
FIG. 2 is a perspective view of a preferred embodiment of a lamp device according to the invention.

As shown in FIG. 2, the preferred embodiment of a lamp device according to the present invention may be embodied as a pendant light, and comprises a lamp shade 2, a bulb socket 3, an electrical cord 4, and a securing unit 5.

The lamp shade 2 includes a shade frame 21, a coupler 23 connected to the shade frame 21, and a shade body 22 covering the shade frame 21.

In this embodiment, the shade frame 21 has a ring component 211 and a plurality of connecting rods 212 that extend toward a center of the ring component 211, at which the coupler 23 is disposed, and that are connected to the coupler 23. The shade body 22 includes a solid shell 221 and an ornamental layer 222 that covers the solid shell 221. In addition, the coupler 23 is ring-shaped.

The bulb socket 3 is disposed in the shade body 22 for connecting to a light bulb 11. The connection between the bulb socket 3 and the light bulb 11 may be, for example, a threaded engagement. The electrical cord 4 has an end electrically connected to the bulb socket 3, and is configured to transmit electricity thereto. In this embodiment, the electrical cord 4 has another end fixed to a higher surface such as a ceiling, and is capable of suspending the lamp device in midair, such that the lamp device may serve as a pendant light.

Figure 3:
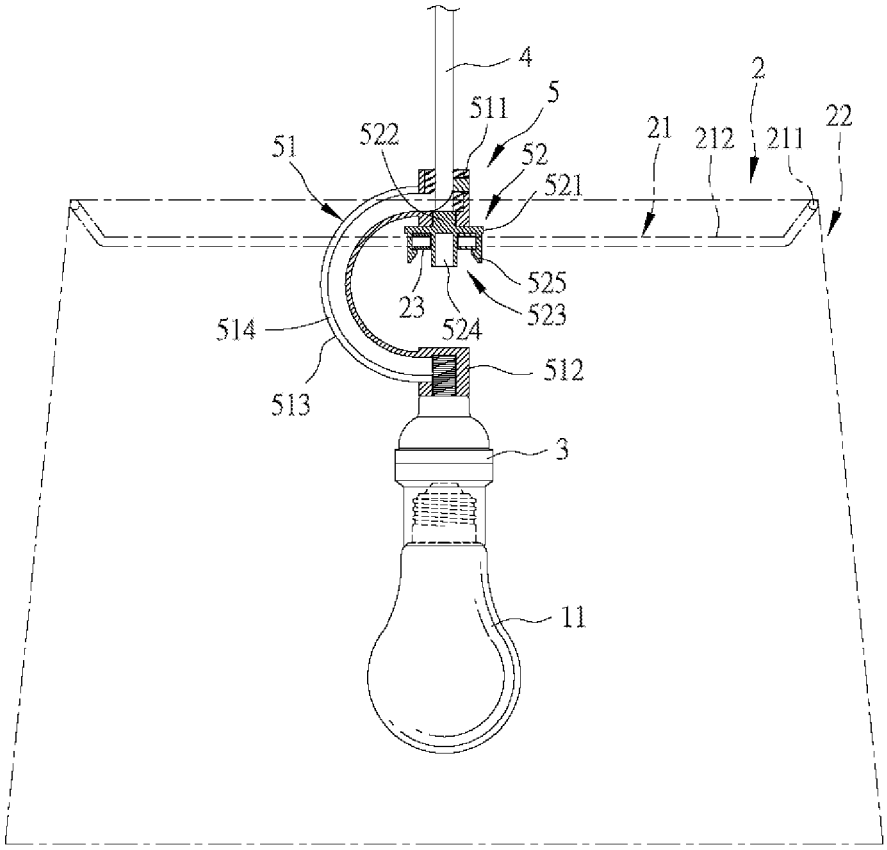
FIG. 3 is a sectional view of the lamp device illustrating components within a lamp shade, which is drawn in broken lines.
Figure 4:
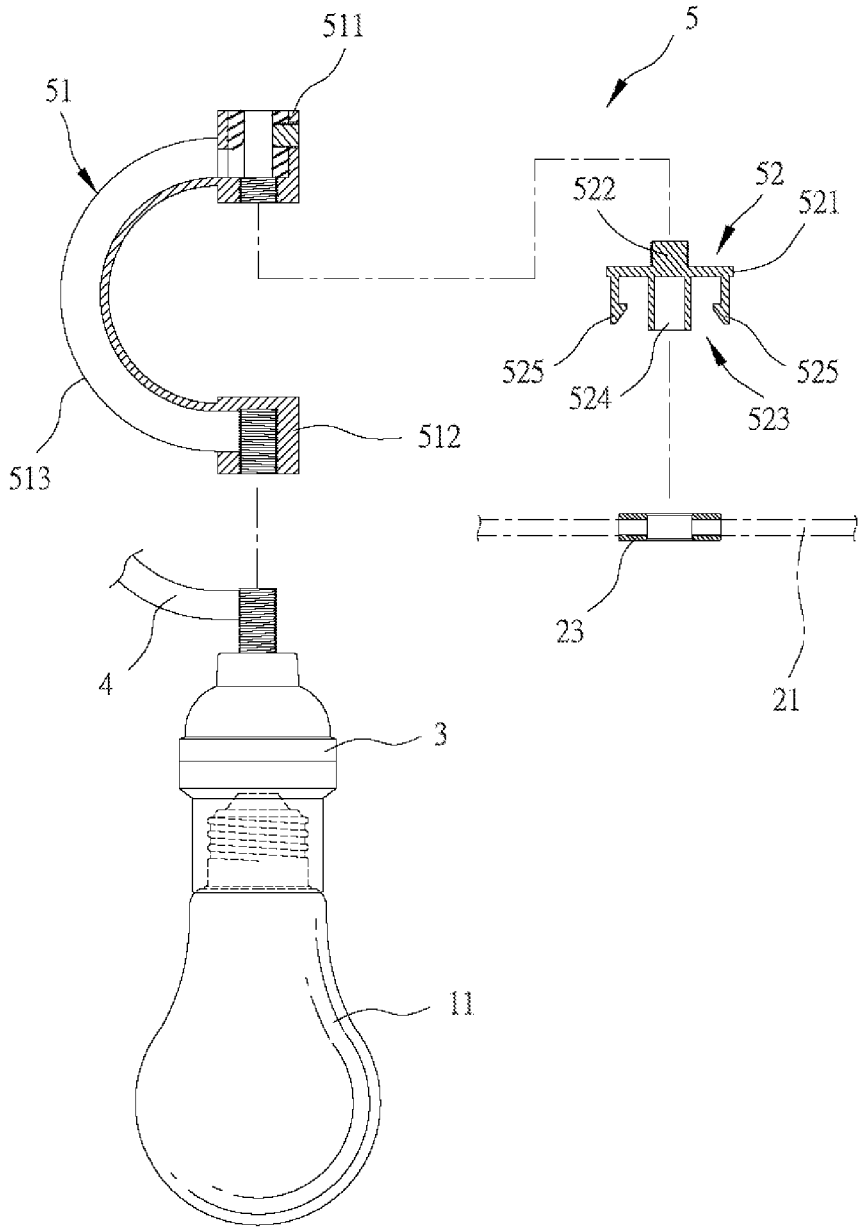
FIG. 4 is a fragmentary exploded sectional view of the lamp device.

Further referring to FIGS. 3 and 4, the securing unit 5 includes a connecting member 51 and a securing member 52. The connecting member 51 has an upper mounting segment 511, a lower connecting segment 512 configured for connection to the bulb socket 3, and a bridging segment 513 having opposite ends connected to the upper mounting segment 511 and the lower connecting segment 512, respectively. The upper mounting segment 511 and the lower connecting segment 512 are tubular. The lower connecting segment 512 is disposed below and spaced apart from the upper mounting segment 511. The bridging segment 513 is arc-shaped, and is formed with a hollow channel 514 which communicates spatially with the upper mounting segment 511 and the lower connecting segment 512. The electrical cord 4 is therefore enabled to extend through the upper mounting segment 511, the channel 514 of the bridging segment 513, and the lower connecting segment 512 and to connect electrically to the bulb socket 3.

As shown in FIG. 4, the securing member 52 includes a base part 521, an engaging part 522, and a resilient holding part 523. The base part 521 has opposite first and second surfaces. The engaging part 522 extends from the first surface of the base part 521 and engages the upper mounting segment 511 of the connecting member 51. The resilient holding part 523 extends from the second surface of the base part 521 and is configured to hold the coupler 23.

In this embodiment, the engaging park 522 is formed as an externally threaded post, and the upper mounting segment 511 of the connecting member 51 is formed with an internally threaded hole to engage threadedly and removably the engaging part 522.

The securing member 52 further includes a positioning post 524, and the resilient holding part 523 includes a plurality of resilient hooks 525. The positioning post 524 is formed as a cylinder, and extends from the second surface of the base part 521 and fittingly through the coupler 23. In this embodiment, two hooks 525 are included in the resilient holding part 523.

The hooks 525 surround the positioning post 524 and cooperate to hold an outer periphery of the coupler 23 of the lamp shade 2, in way of a snap fastener. Specifically, the hooks 525 cooperate to define a retaining space that has a site corresponding to the site of the coupler 23. When it is to detach the securing member 52 from the lamp shade 2, a force is applied to each of the hooks 525 to move the same away from the positioning post 524.

Figure 5:
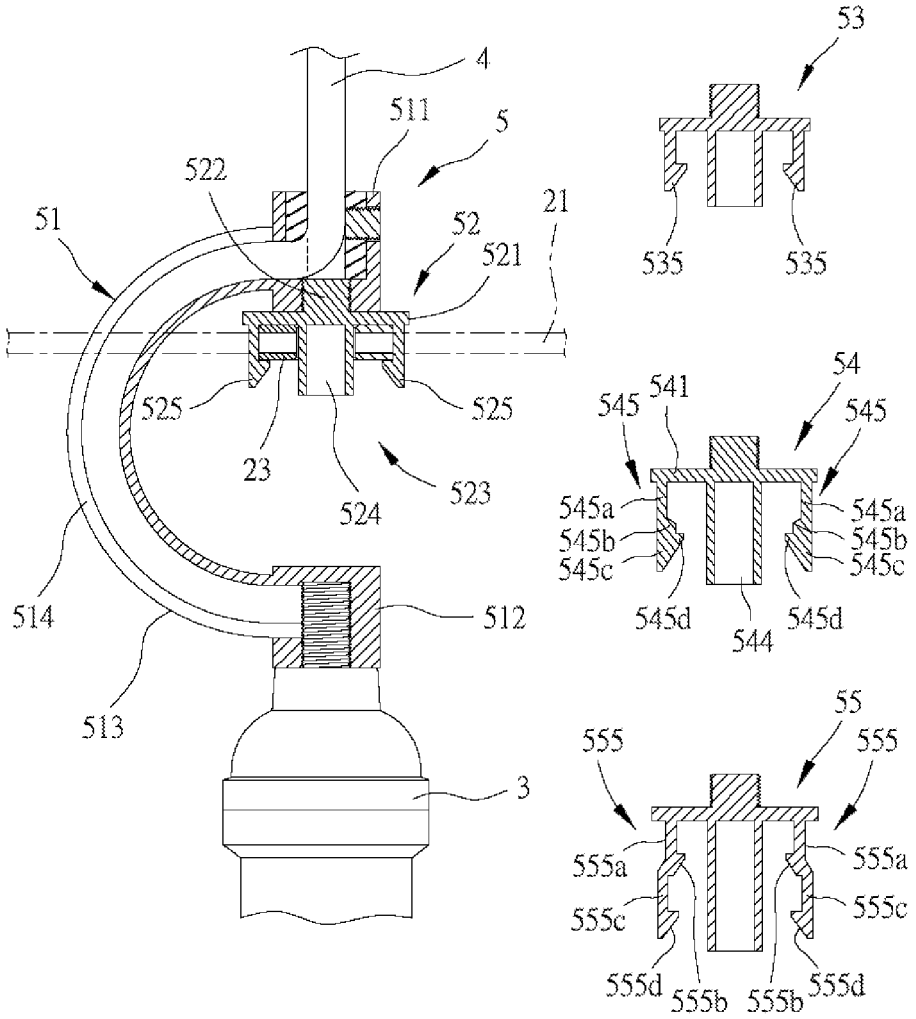
FIG. 5 is a fragmentary sectional view of a securing unit of the lamp device, with a plurality of exemplary securing members that can detachable hold a coupler of a lamp shade.

In order to accommodate many types of commercially available lamp shades 2 each including a coupler 23 with a different sire specification, one or more additional securing members may be employed. For example, FIG. 5 illustrates three exemplary securing members 53 to 55.

The securing member 53 has a structure similar to that of the securing member 52. The difference between the securing members 52 and 53 is that a plurality of hooks 535 included in the securing member 53 cooperate to define a coupler retaining space that has a size different from the size of the coupler retaining space defined cooperatively by the hooks 525 of the securing member 523.

The securing member 54 has a structure similar to that of the securing member 52. The difference between the securing members 52 and 54 is that a plurality of hooks 545 included in the securing member 54 cooperate to define a first coupler retaining space and a second coupler retaining space.

Specifically, each of the hooks 545 that surrounds the positioning post 544 includes an upper hook body segment 545*a* connected to the base part 541, a lower hook body segment 545*c* extending downwardly from the upper hook body segment 545*a*, a shoulder 545*b* protruding from an inner side surface of the hook 545 at a junction of the upper hook body segment 545*a* and the lower hook body segment 545*c*, and a barb 545*d* projecting from the inner side surface of the hook 545 and disposed below the shoulder 545*b*.

Figure 6:
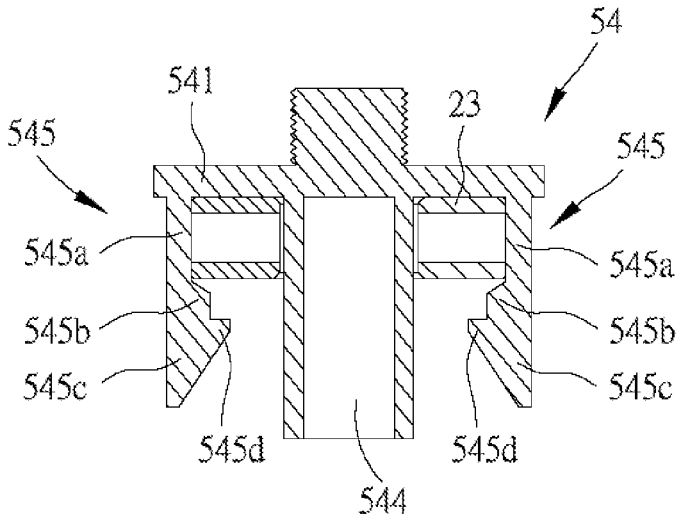
FIGS. 6 and 7 are sectional views illustrating two couplers having different sizes being held respectively in a first coupler retaining space and a second coupler retaining space defined by one of the exemplary securing members.
Figure 7:
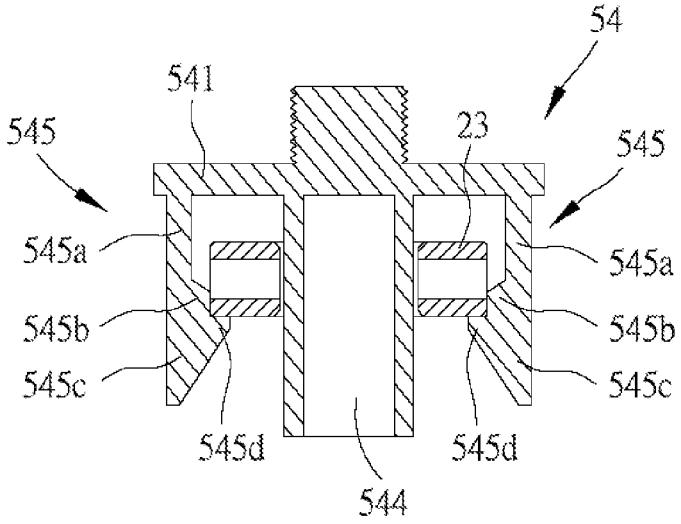

The upper hook body segments 545*a* of the hooks 545 cooperate to define the first coupler retaining space. Similarly, the shoulders 545*b* of the hooks 545 cooperate to define the second coupler retaining space, which is narrower than the first coupler retaining space. As shown in FIGS. 6 and 7, the securing member 54 is capable of securing to two different sizes of the coupler 23.

Figure 8:
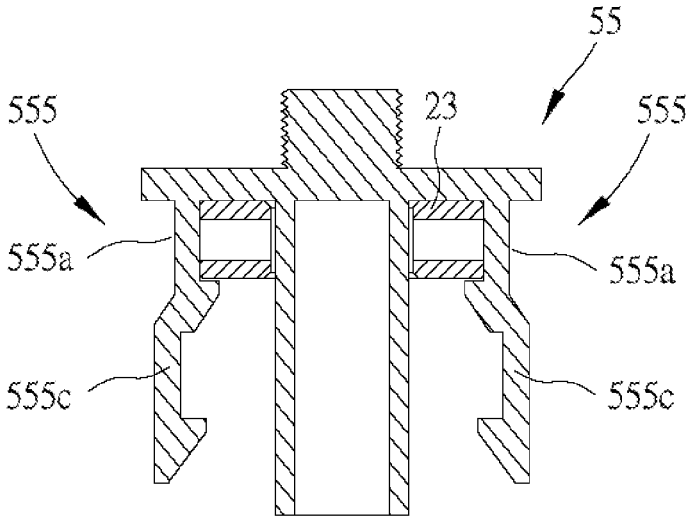
FIGS. 8 and 9 are sectional views illustrating two couplers having different sizes being held respectively in a first coupler retaining space and a second coupler retaining space defined by another one of the exemplary securing members.
Figure 9:
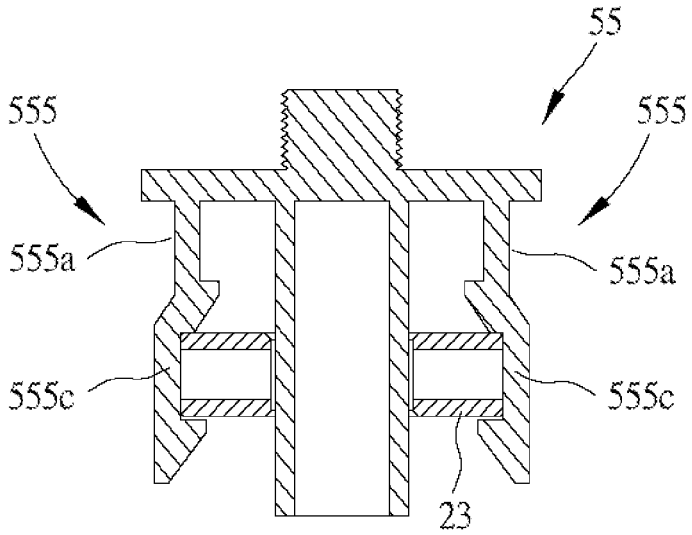

The securing member 55 has a structure similar to that of the securing member 54. The difference between the securing members 54 and 55 is that the first coupler retaining space defined by the securing member 55 is narrower than the second coupler retaining space. Specifically, as shown in FIGS. 8 and 9, the lower hook body segment 555*c* of each of the hooks 555 further extends downwardly from the upper hook body segment 555*a* and outwardly relative to the positioning post 554 before extending downwardly. Therefore, the second coupler retaining space is wider than the first coupler retaining space.

While the lamp device is exemplified as a pendant light in the preferred embodiment, other forms of electric lamps or light fixtures may benefit from the present invention.

To sum up, by employing the structure of the securing unit 5, the present invention provides a convenient way to ensure that the coupler 23 is able to be firmly secured to the bulb socket 3, regardless of the size specification of the coupler 23.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

What is claimed is:

1. A securing unit for securing a lamp shade to a bulb socket, the lamp shade including a shade frame, and a coupler connected to the shade frame, the bulb socket to be disposed in the lamp shade, said securing unit comprising:

a connecting member having an upper mounting segment, and a lower connecting segment disposed below said upper mounting segment and configured for connection to the bulb socket; and a securing member including a base part having opposite first and second surfaces, an engaging part extending from said first surface of said base part and engaging said upper mounting segment of said connecting member, and a resilient holding part extending from said second surface of said base part and configured to hold the coupler;

wherein said resilient holding part of said securing member includes a plurality of hooks that are configured to cooperatively hold an outer periphery of the coupler;

wherein each of said hooks includes an upper hook body segment connected to said base part, a lower hook body segment extending downwardly from said upper hook body segment, a shoulder protruding from an inner side surface of said hook at a junction of said upper hook body segment and said lower hook body segment, and a barb projecting from said inner side surface of said hook and disposed below said shoulder;

wherein said upper hook body segments of said hooks cooperate to define a first coupler retaining space, and said shoulders of said hooks cooperate to define a second coupler retaining space narrower than said first coupler retaining space.

2. The securing unit of claim 1, the bulb socket having an electrical cord connected thereto, wherein:

said connecting member further has a bridging segment, said bridging segment having opposite ends connected to said upper mounting segment and said lower connecting segment, respectively;

said upper mounting segment and said lower connecting segment being configured to permit passage of the electrical cord therethrough;

said bridging segment being formed with a channel adapted to receive a part of the electrical cord.

3. The securing unit of claim 1, wherein said engaging part is formed as an externally threaded post, and said upper mounting segment of said connecting member is formed with an internally threaded hole to engage threadedly and removably said engaging part.

4. The securing unit of claim 1, the coupler being ring-shaped, wherein said securing member further has a positioning post that extends from said second surface of said base part and that is adapted to extend through the coupler.

5. The securing unit of claim 4, wherein said hooks are disposed to surround said positioning post.

6. A lamp device comprising:

a lamp shade including a shade frame, and a coupler connected to said shade frame;

a bulb socket disposed in said lamp shade; and a securing unit including:

a connecting member having an upper mounting segment, and a lower connecting segment disposed below said upper mounting segment and connected to said bulb socket; and a securing member including a base part having opposite first and second surfaces, an engaging part extending from said first surface of said base part and engaging said upper mounting segment of said connecting member, and a resilient holding part extending from said second surface of said base part and configured to hold said coupler;

wherein said resilient holding part of said securing member includes a plurality of hooks that cooperate to hold an outer periphery of said coupler;

wherein each of said hooks includes:

an upper hook body segment connected to said base part, a lower hook body segment extending downwardly from said upper hook body segment, a shoulder protruding from an inner side surface of said hook at a junction of said upper hook body segment and said lower hook body segment, and a barb projecting from said inner side surface of said hook and disposed below said shoulder;

wherein said upper hook body segments of said hooks cooperate to define a first coupler retaining space, and said shoulders of said hooks cooperate to define a second coupler retaining space narrower than said first coupler retaining space.

7. The lamp device of claim 6, further comprising an electrical cord connected to said bulb socket;

said connecting member further having a bridging segment, said bridging segment having opposite ends connected to said upper mounting segment and said lower connecting segment, respectively;

said upper mounting segment and said lower connecting segment being configured to permit passage of said electrical cord therethrough;

said bridging segment being formed with a channel to receive a part of said electrical cord.

8. The lamp device of claim 6, wherein said engaging part is formed as an externally threaded post, and said upper mounting segment of said connecting member is formed with an internally threaded hole to engage threadedly and removably said engaging part.

9. The lamp device of claim 6, wherein said coupler is ring-shaped, and said securing member further has a positioning post that extends from said second surface of said base part and through said coupler.

10. The lamp device of claim 9, wherein said hooks are disposed to surround said positioning post.

* * * * *